US005188088A

United States Patent [19]

Stamm et al.

[11] Patent Number: 5,188,088

[45] Date of Patent: Feb. 23, 1993

[54] ELECTRONIC IGNITION SYSTEM FOR AN INTERNAL COMBUSTION ENGINE

[75] Inventors: Klaus Stamm, Wolfsburg; Siegbert Graf vom Hagen, Bensheim, both of Fed. Rep. of Germany

[73] Assignee: Volkswagen AG, Wolfsburg, Fed. Rep. of Germany

[21] Appl. No.: 828,914

[22] PCT Filed: Jul. 20, 1990

[86] PCT No.: PCT/EP90/01192

§ 371 Date: Jan. 28, 1992

§ 102(e) Date: Jan. 28, 1992

[87] PCT Pub. No.: WO91/02153

PCT Pub. Date: Feb. 21, 1991

[30] Foreign Application Priority Data

Jul. 28, 1989 [DE] Fed. Rep. of Germany ..... 3924985

[51] Int. Cl.[5] ..... F02P 3/08

[52] U.S. Cl. ..... 123/620; 123/602; 123/643

[58] Field of Search ..... 123/596, 598, 602, 620, 123/625, 636, 637, 643

[56] References Cited

U.S. PATENT DOCUMENTS

| | | | |
|---|---|---|---|
| 3,837,326 | 9/1974 | Kamiji | 123/598 |
| 4,122,816 | 10/1978 | Fitzgerald et al. | 123/598 |
| 4,317,068 | 2/1982 | Ward et al. | 315/209 CD |
| 4,359,037 | 11/1982 | Stangl | 123/643 |
| 4,369,757 | 1/1983 | Anzai | 123/620 |
| 4,462,380 | 7/1984 | Asil | 123/620 |
| 4,478,201 | 10/1984 | Asil | 123/620 |
| 4,558,685 | 12/1985 | Ishiawa et al. | 123/620 |
| 4,562,822 | 1/1986 | Ishiawa et al. | 123/620 |
| 4,567,874 | 2/1986 | Rouanes | 123/606 |
| 4,886,036 | 12/1989 | Johannson et al. | 123/620 X |
| 4,938,200 | 7/1990 | Iwasaki | 123/620 |
| 5,009,213 | 4/1991 | Di Nunzio et al. | 123/643 X |

FOREIGN PATENT DOCUMENTS

| | | | |
|---|---|---|---|
| 0001354A1 | 4/1979 | European Pat. Off. . | |
| 0034787 | 2/1981 | European Pat. Off. . | |
| 0071910A2 | 2/1983 | European Pat. Off. . | |
| 2533570 | 2/1977 | Fed. Rep. of Germany . | |
| 2340865 | 6/1979 | Fed. Rep. of Germany . | |
| 3008066 | 9/1981 | Fed. Rep. of Germany . | |
| 2603951A | 3/1988 | France . | |
| 159563 | 12/1981 | Japan | 123/620 |
| WO8801690 | 3/1988 | PCT Int'l Appl. . | |
| 1257794 | 12/1971 | United Kingdom . | |
| 2098756A | 11/1981 | United Kingdom . | |
| 2173601A | 10/1986 | United Kingdom . | |

*Primary Examiner*—Willis R. Wolfe

*Attorney, Agent, or Firm*—Brumbaugh, Graves, Donohue & Raymond

[57] ABSTRACT

An electronic ignition system provides precisely timed spark plug ignition in the combustion chambers of an internal combustion engine and provides an optimal supply of ignition energy for the required operating mode by including a programmable transistor ignition system ("PTI") controllable according to engine operating parameters which can execute a joint program for all spark plugs. The PTI is connected in series with high-voltage capacitor ignition devices associated with the individual spark plugs and supplies ignition energy to them repeatedly during each ignition process.

20 Claims, 10 Drawing Sheets

Fig.12
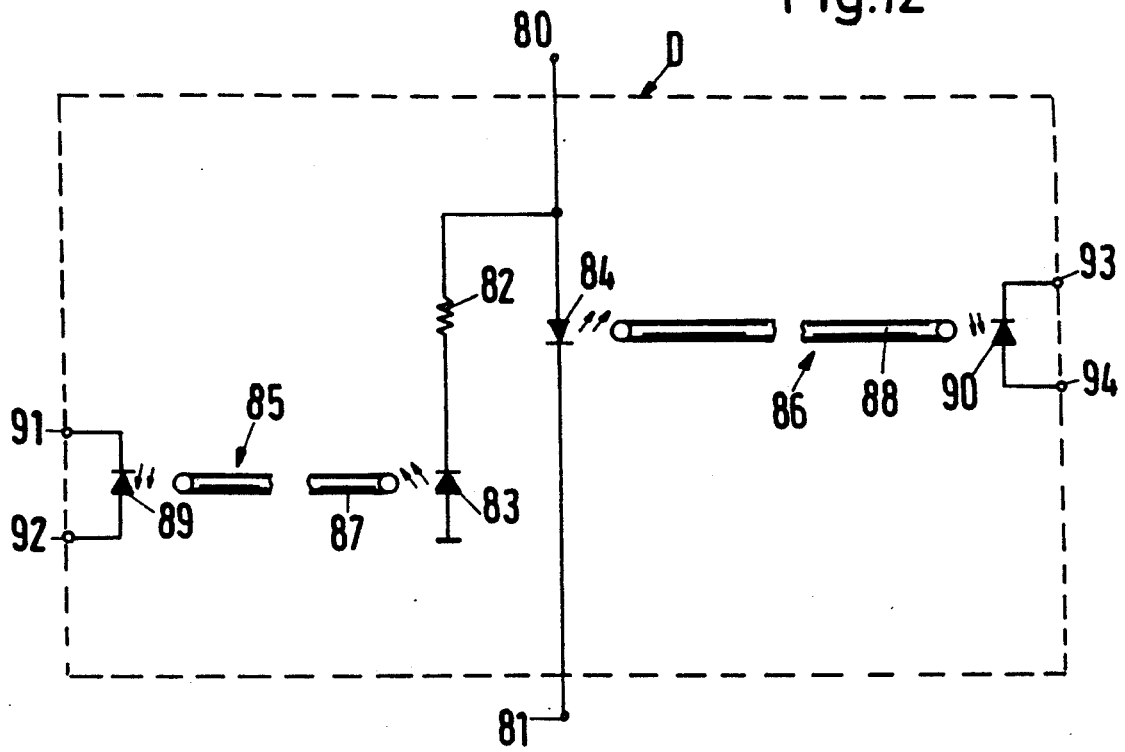
Fig.13
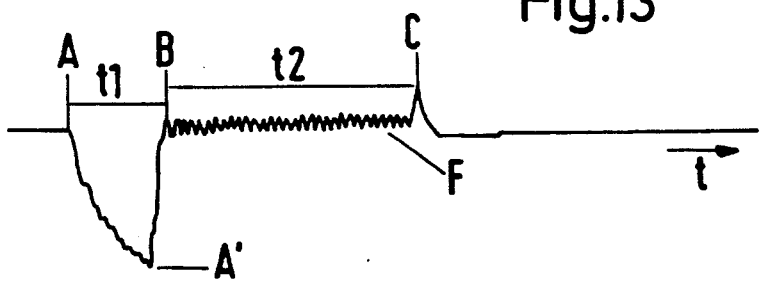
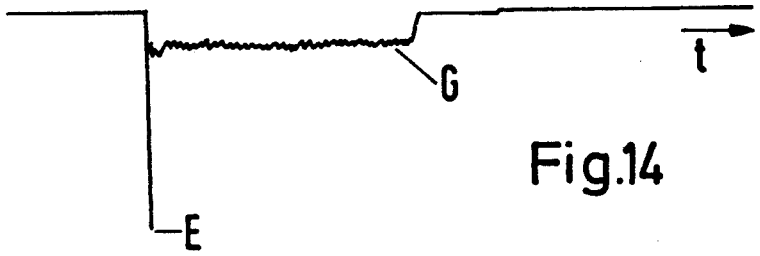
Fig.14

Fig.15
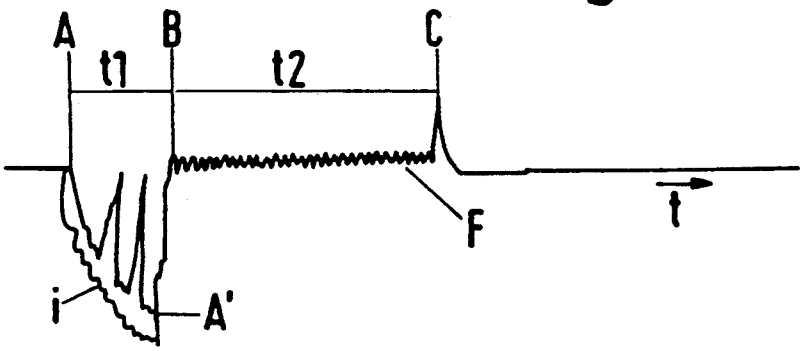
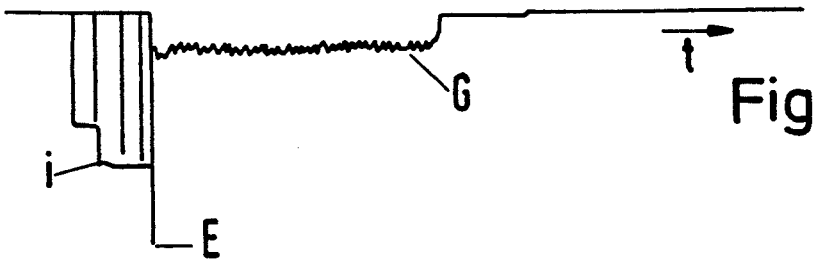
Fig.16
Fig.17
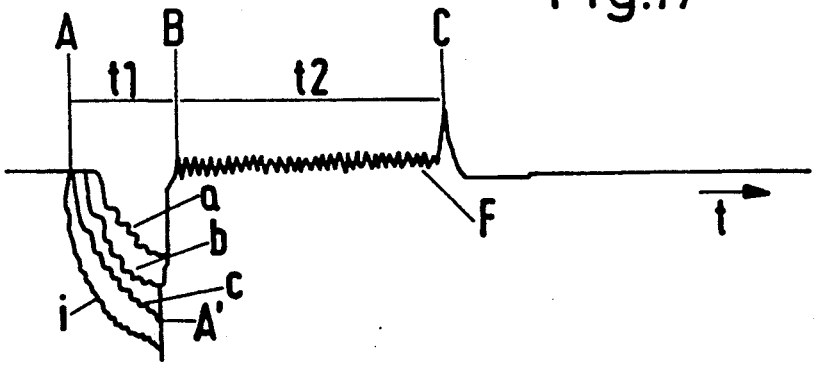
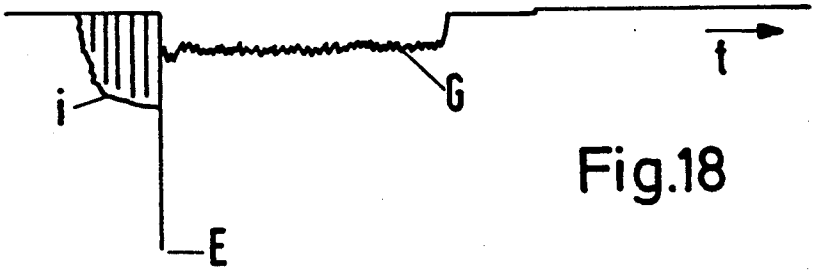
Fig.18

Fig.19
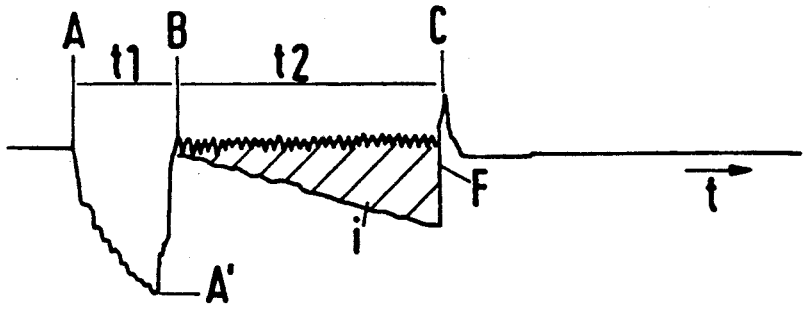
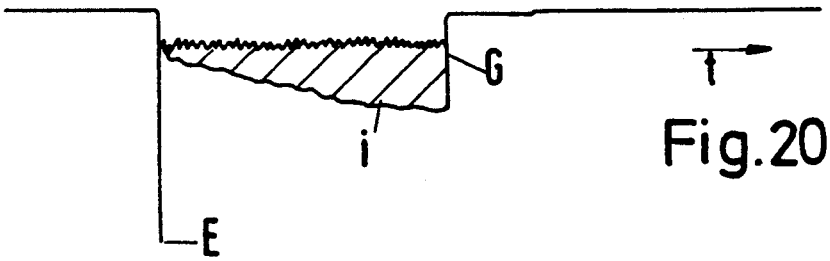
Fig.20
Fig.21
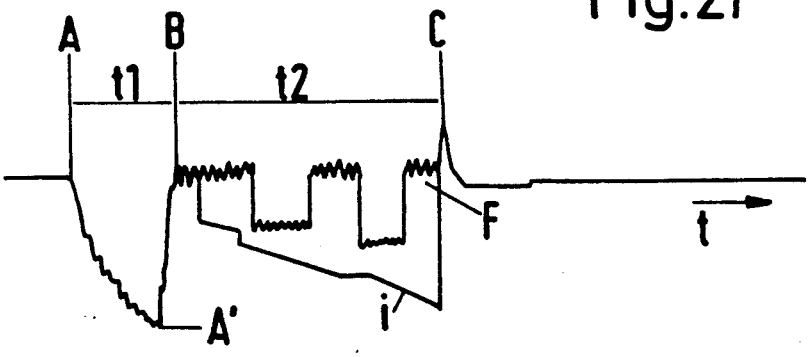
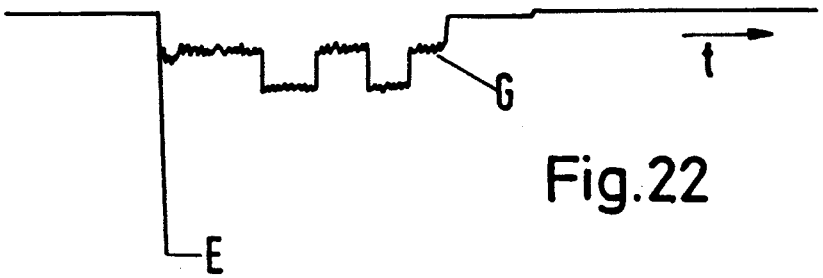
Fig.22

ELECTRONIC IGNITION SYSTEM FOR AN INTERNAL COMBUSTION ENGINE

BACKGROUND OF THE INVENTION

This invention relates to electronic ignition systems for internal combustion engines.

Published European Application No. 0 071 910 A2 discloses an electronic ignition system having individual spark plug ignition devices as well as an additional ignition device common to all spark plugs. In that system, transistor ignition devices with current regulation are used as the individual spark plug ignition devices and the common ignition device contains a regulated direct-current converter connected, by way of diodes, to the secondary windings of the ignition coils of those ignition devices. Both types of ignition devices may be controlled or regulated as a function of parameters of the internal combustion engine, such as rpm, load and knocking.

A disadvantage of this prior art ignition system is that essentially only a single ignition pulse is supplied by the direct-current converter for each ignition process. As a result, difficulties may occur in ignition with a lean mixture, especially in operating modes of the internal combustion engine which are of interest in view of modern reduced emission objectives.

In this respect, more favorable behavior is provided by a programmable transistor ignition system, hereinafter called a "PTI", such as is disclosed in German Offenlegungsschrift No. 23 40 865. That PTI contains an electronic switch connecting a direct-current voltage source into an output transformer and having a switching frequency which is a multiple of the firing frequency of each spark plug. Like the conventional ignition device, the PTI is controllable according to operating and environmental parameters. A disadvantage of this known PTI is the requirement for a mechanical distributor, which is known to be relatively susceptible to trouble. In addition, the PTI does not supply very precisely timed ignition sparks.

SUMMARY OF THE INVENTION

Accordingly, it is an object of the present invention to provide a fully electronic ignition system for an internal combustion engine which overcomes the above-mentioned disadvantages of the prior art.

Another object of the invention is to provide a fully electronic ignition system which ensures satisfactory precisely timed ignition, even when the internal combustion engine is operated with a lean fuel-air mixture, and which does not require a mechanical distributor.

These and other objects of the invention are attained by providing an ignition system in which each spark plug is supplied from a separate high-voltage condenser ignition device, hereinafter called an "HVCI", having an output transformer and a plurality of spark plugs are controlled by a common PTI having an electronic switch operating at a frequency which is a multiple of the firing frequency of each spark plug and which controls the operation of the HVCI for each of the spark plugs as a function of operating and environmental parameters.

The use of a PTI as an ignition control device which supplies a series of spark impulses for each ignition process produces a relatively strong ionization of the combustion chamber gases in the vicinity of the spark plug, which results in greater assurance of complete ignition than does the use of a single direct-current converter. Because each spark plug is connected to a separate HVCI and an electronic distributor is used as in the transistorized coil ignition devices disclosed in the above-mentioned EP No. 0 071 910 A2, a mechanical distributor is not required.

Although the ignition energy supplied by each HVCI is limited, the HVCIs have a high timing accuracy. Consequently, in the ignition system according to the invention, the actual ignition energy is provided to the HVCIs by the PTI with relatively limited timing accuracy, while the HVCIs provide precisely timed high voltages to the individual ignition coils.

An additional advantage of the invention results from the fact that the HVCIs can be standard components since all of the features of the ignition system required by a particular engine are determined by the PTI.

Another advantage of the invention is that HVCI devices are conventional components as described in the extensive patent literature in this field, such as European Published Application No. 0 001 354 A1.

As can be seen from the following description of particular examples, the ignition system according to the invention permits the use of a simple diagnostic device that supplies informative data. A particular advantage of the invention in this connection is that a central diagnostic device may be used which is common to all combustion chambers. In engines for motor vehicles, this device may be built into the vehicle so that, if necessary, the driver may be given information concerning the status of the ignition system, including the spark plugs.

BRIEF DESCRIPTION OF THE DRAWINGS

Further objects and advantages of the invention will be apparent from a reading of the following description in conjunction with the accompanying drawings in which:

FIG. 12 is a schematic diagram showing the arrangement of one form of diagnostic arrangement for use in the invention;

FIGS. 13 and 14 are graphical illustrations showing typical curves produced by the diagnostic arrangement of FIG. 12;

FIGS. 15 and 16 and FIGS. 17 and 18 are graphical illustrations showing voltage and current curves, respectively, which are produced by the diagnostic arrangement for various insulation failures in the ignition system;

FIGS. 19 and 20 are graphical illustrations showing voltage and current curves as a function of the electrode gap of the spark plug;

FIGS. 21 and 22 are graphical illustrations showing voltage and current curves during interruptions of the combustion in the ignition process;

DESCRIPTION OF PREFERRED EMBODIMENTS

As can be understood from the foregoing summary, the PTI forms an essential component of an ignition system arranged according to the invention. The basic design of a PTI ignition system, as disclosed in German Offenlegungsschrift No. 23 40 865, will therefore be described hereinafter with reference to FIG. 1.

Figure 1:
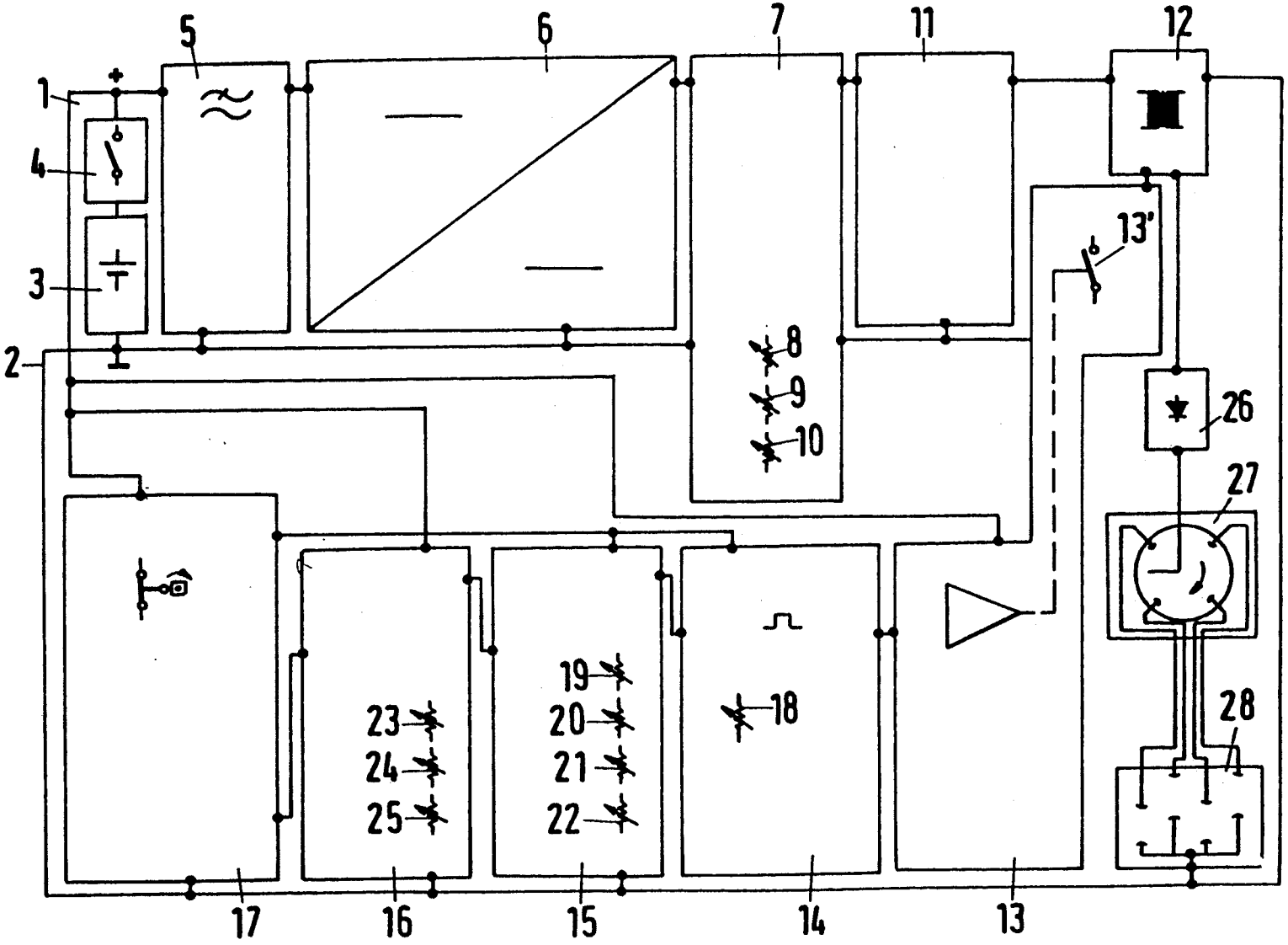
FIG. 1 is a schematic block wiring diagram illustrating the arrangement of a conventional PTI.

The electronic components of the ignition system shown in FIG. 1 are connected through a positive line 1 and a negative line 2 to a direct-current voltage source 3 by way of an ignition switch 4 disposed between the positive line 1 and the positive terminal of the voltage source 3. The direct-current voltage source 3 may have a voltage of, for example, 12 V, as is customary in motor vehicles.

A direct-current voltage converter 6 is connected through a filter 5 to the positive and negative lines 1 and 2. The filter 5 is a conventional low-pass filter consisting of inductances and condensers which isolates the switching frequency of the direct-current converter 6 from the direct-current voltage source 3 to prevent disturbance of the direct-current voltage supply.

The direct-current voltage converter 6 may be a conventional push-pull converter or a single-ended converter arranged to convert the voltage of the direct-current voltage source 3 to a direct-current voltage of, for example, 50–100 V, preferably 70 V. The output of the direct-current voltage converter 6 is connected to the input of a conventional current regulator 7 in which the actual value and the desired value of the current (i.e., the ignition energy) are compared. The desired value setting is provided by three control elements 8, 9 and 10, which may be potentiometers, for example. The control element 8 is actuated as a function of the setting of the output control element of the engine, the control element 9 is actuated as a function of the ignition time point, and the control element 10 is actuated as a function of the fuel-air ratio.

A voltage regulator 11 connected to the current regulator 7 to maintain the output voltage constant has its output side connected to the primary winding of an ignition transformer 12.

One terminal of the primary winding of the ignition transformer 12 is connectable through an electronic switch 13 to the negative reference points of the current regulator 7 and to the voltage regulator 11. The switching frequency of the on or off status of the switch 13 is determined by a pulse generator 14 in conjunction with two timing elements 15 and 16 and an ignition timer 17. Switching of the switch 13 thus induces an oscillating voltage in the primary winding of the ignition transformer 12, which is transformed into a high voltage in the secondary winding.

The switch 13 consists essentially of transistors arranged, for example, in a Darlington circuit, along with resistors for adjustment of the operating point of a switching transistor which is represented in the drawing as a switch 13'. The pulse generator 14 connected to the switch 13 operates in a conventional manner, for example, as an astable multivibrator, and a potentiometer 18 varies the frequency of the pulse generator 14 to optimize the switching frequency to the transmission characteristics of the ignition transformer 12. The pulse generator 14 is switched on and off for preselectable intervals of time by the timing element 15, which may be designed as a conventional monostable multi-vibrator. The switch-on interval is variable within wide limits and the desired value setting is effected by four control elements 19, 20, 21, and 22, which may, for example, be potentiometers. The control element 19 is actuated as a function of the rpm, the control element 20 is actuated as a function of the setting of the output control element, the control element 21 is actuated as a function of the ignition time point and the control element 22 is actuated as a function of the fuel-air ratio.

The timing element 15 is switched on by the timing element 16, which may be designed as a conventional monostable multivibrator, and the time delay which is initiated by the timing element 16 for the start of ignition energy generation is variable within wide limits. The desired value is determined by three control elements 23, 24 and 25, which may be potentiometers, again as a function of rpm, setting of the output control element and fuel-air ratio. The timing element 16 is switched on by the ignition timer 17 which serves to initiate the ignition process by opening a breaker contact.

The alternating high voltage produced in the secondary winding of the ignition transformer 12 has a frequency which is determined by the pulse generator 14 and an effective duration which is determined by the timing element 15, where triggering by the ignition timer 17 is effected in conjunction with the timing element 16. This voltage is supplied through a rectifier 26 and a distributor 27 to a series of spark plugs in a cylinder head 28.

The advantage of a PTI of this type is that, by supplying a series of ignition sparks as a function of parameter values for each mixture ignition, it provides greater assurance of effective ignition due to stronger ionization.

Accordingly, such a conventional PTI is provided as an important part of the ignition system according to the invention to supply ignition energy to each of the spark plugs during its corresponding combustion or burning times. During the combustion time, a succession of individual pulses is generated, each of which leads to an ignition spark. As described above, the current amplitude of each pulse and the pulse frequency may be freely varied as a function of engine parameters. The ignition energy of each ignition process consists of the current amplitude of each individual pulse, its time duration and the number of pulses within the duration of combustion, which is also freely variable.

The present invention eliminates the effect of certain timing inaccuracies in the operation of the PTI, as well as avoiding the necessity for a mechanical distributor in the PTI by providing an individual HVCI for each spark plug to produce an ignition discharge for an exact time period at the spark plug. The basic design of the HVCIs is explained hereinafter with reference to the typical example of the invention illustrated in FIG. 2.

In this example, as in the other examples, a four-cylinder internal combustion engine with four spark plugs 30, 31, 32 and 33, one for each combustion chamber, is assumed. Common to all four spark plugs 30–33 is a PTI connected between two terminals 34 and 35, which has the conventional design described above with reference to FIG. 1 except that it does not include the distributor 27. The PTI is therefore indicated only by the reference numeral 36 in FIG. 2 and in the remaining figures.

Figure 2:
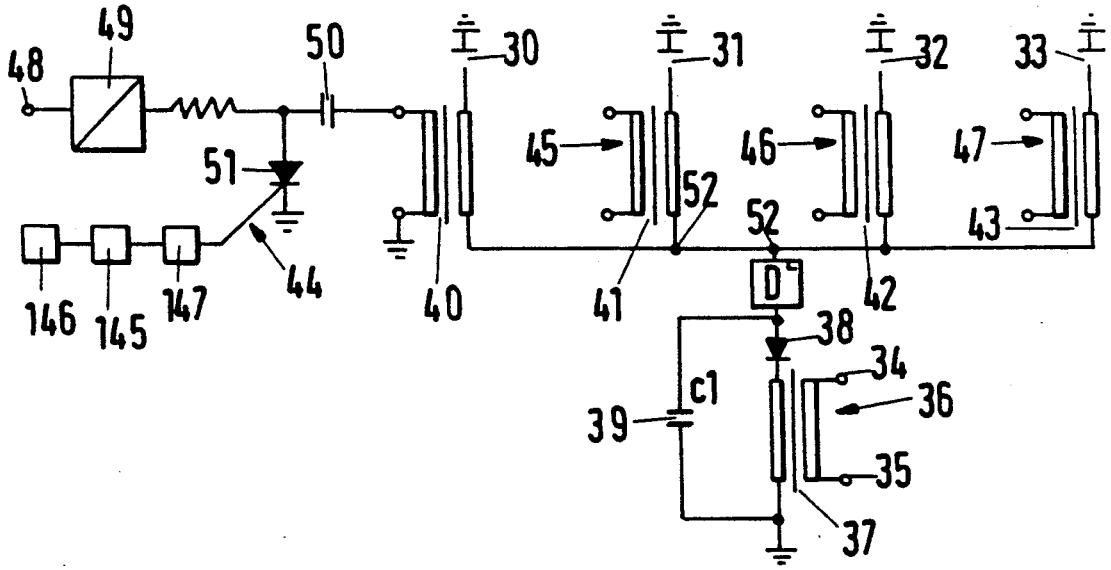
FIGS. 2–5 are schematic diagrams illustrating the arrangement of several representative embodiments of an ignition system according to the invention.

As shown in FIG. 2, a diode 38 is connected in series with the output transformer 37 of the PTI 36 and a condenser 39 is connected in parallel with this series connection.

Four HVCIs 44, 45, 46 and 47 with corresponding ignition coils 40, 41, 42 and 43 are assigned to the spark plugs 30, 31, 32 and 33, respectively. These HVCIs have the same arrangement, which is shown in detail only for the HVCI 44 assigned to the spark plug 30, and they are identified by the same reference numerals in the other drawings since all of the HVCIs may have the same structure. As shown in FIG. 2, these HVCIs are connected to the primary windings of the ignition coils 40–43.

Referring to the arrangement of the HVCI 44, a direct-current converter 49 is connected to the positive terminal 48 of the vehicle battery and a condenser 50 is connected between the converter and the ignition coil 40. A switching transistor 51, connected between the condenser 50 and ground, is rendered conductive by a triggering device 147 as a function of output signals from control unit 145, which is acted on by signals from a Hall device 146 of a distributor. The condenser 50 is thus discharged through the primary winding of the ignition coil 40 when ignition is to be effected by the spark plug 30 in the associated combustion chamber.

To make certain that the ignition energy is not transmitted to the other spark plugs 31, 32 and 33, which are also connected through a junction 52 to the PTI 36, in other words, that ignition does not occur in the "wrong" combustion chambers, care must be taken that the voltage at the junction 52 between the PTI 36 and the HVCIs 40–43 does not exceed a given value, for example, 1.5 kV. This is accomplished by appropriate selection of the condenser 39 and the diode 38 based on the inductance of the secondary winding of the output transformer 37 of the PTI 36.

Between the diode 38 and the junction 52, there is a diagnostic unit D which will be described hereinafter with reference to other figures. At this point, it should only be noted that the invention provides for convenient installation of a diagnostic unit, as shown in FIG. 2, which preferably is incorporated in the vehicle containing the internal combustion engine.

In the description of the following examples, the reference numerals used for certain parts in FIG. 2 are used for corresponding parts in the other embodiments illustrated in subsequent figures.

Figure 3:
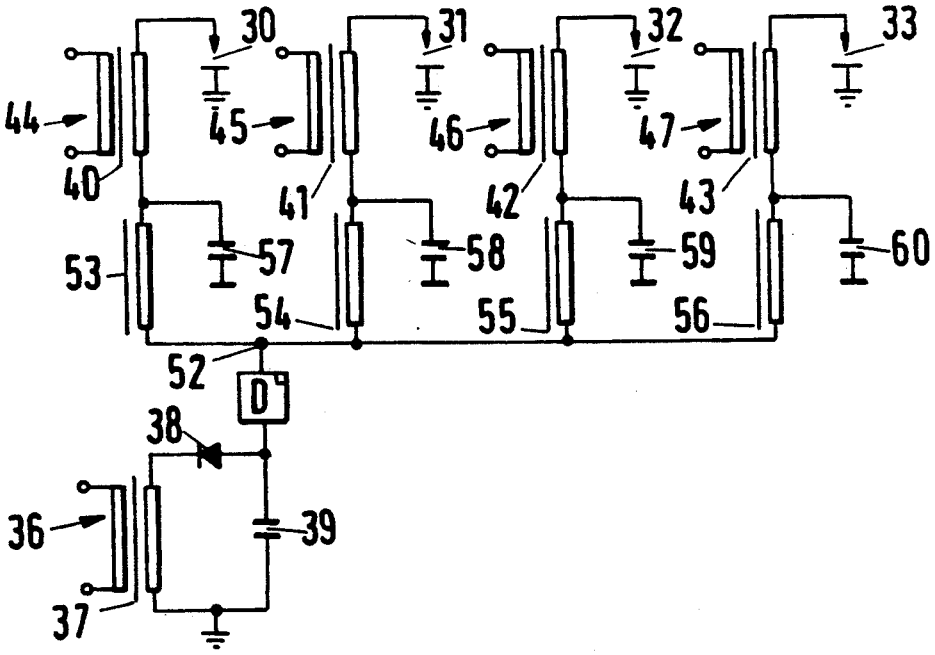

Referring to the typical embodiment shown in FIG. 3, this embodiment differs from that of FIG. 2 by including four individual spark plug inductances 53, 54, 55 and 56, inserted between the junction 52 and the HVCIs 44–47, respectively, to each of which is assigned a capacitor 57, 58, 59 and 60. These capacitors may constitute the winding capacitances of the inductances 53–56. The inductances 53–56, in cooperation with the condenser 39, prolong the duration of the corresponding HVCI ignition spark and, for small ignition currents, intensify the ionizing effect of the sparks produced by the HVCIs. Accordingly, their significance is in providing a "transition" between the HVCI and the PTI in cases in which the ignition energy produced by the PTI 36 does not cause ionization in the corresponding cylinder charge.

Figure 4:
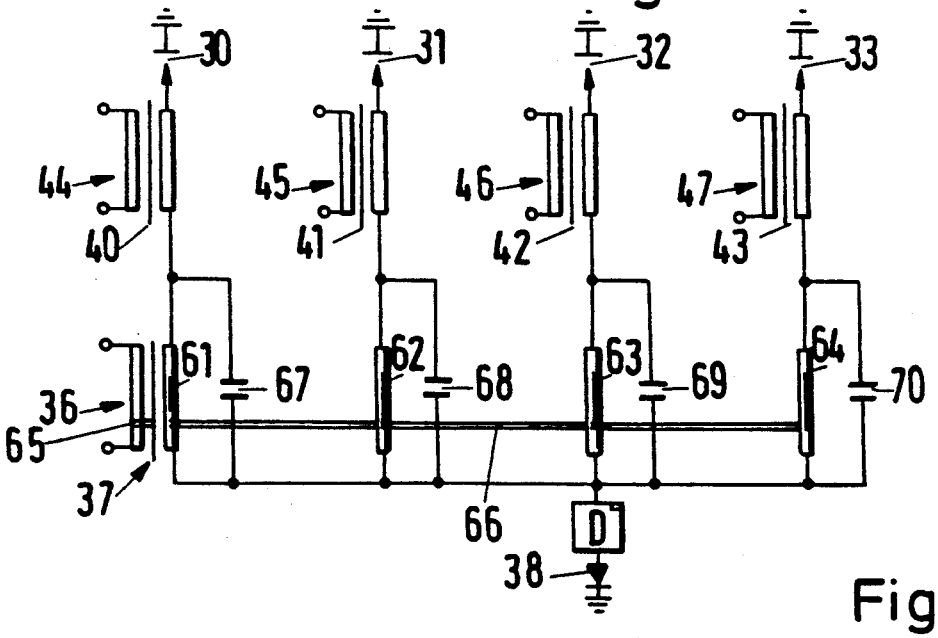

In the further embodiment of the invention shown in FIG. 4, individual spark plug secondary windings 61, 62, 63 and 64 of the output transformer 37 of the PTI 36 are connected in series with corresponding secondary windings of the ignition coils 40–43. The magnetic coupling of the secondary windings 61–64 with the primary winding 65 of the transformer 37 is represented in the drawing by a bar 66. Four condensers 67, 68, 69 and 70, which correspond in function and size to the single condenser 39 of the previous embodiments, are connected in parallel to the secondary windings 61–64. In this embodiment, the diode 38 is located in the ground connection of the ignition system. If desired, individual diodes could instead be connected to each of the secondary windings 61–64. This embodiment provides the advantage of substantial decoupling of the ignition processes for the individual spark plugs 30–33 from each other.

Figure 5:
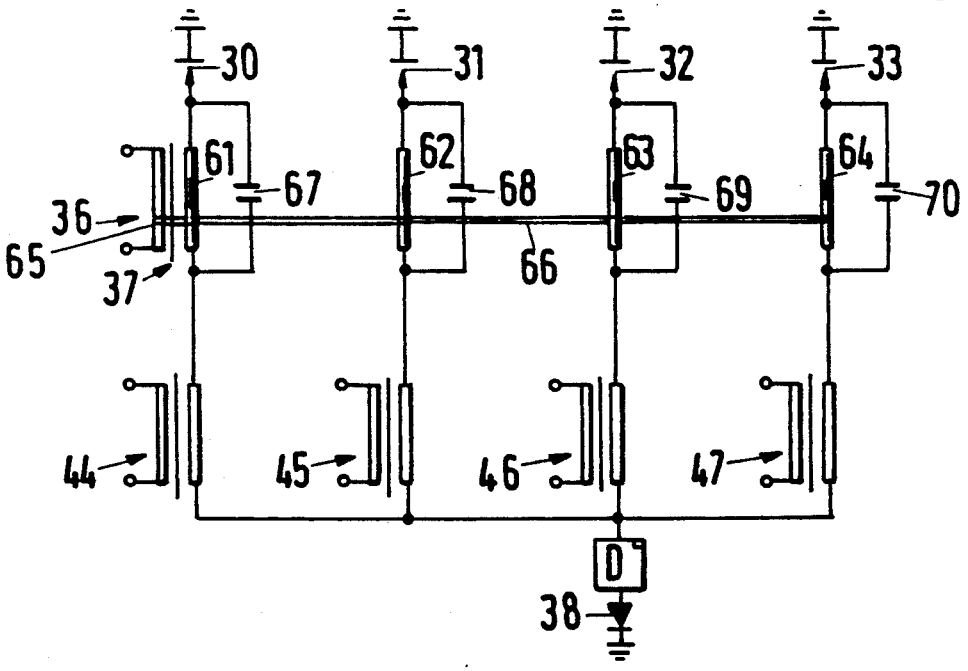

The same advantage is provided by the circuit illustrated in FIG. 5, in which the locations of the HVCIs 44–47 and the PTI 36 are reversed with respect to FIG. 4.

Figure 6:
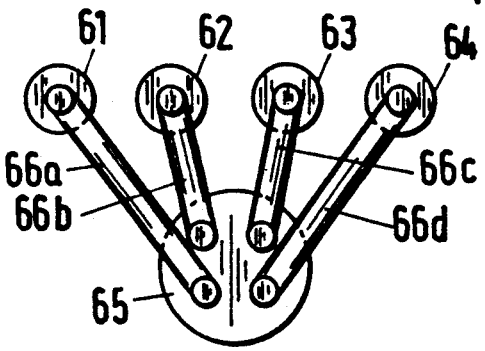
FIG. 6 is a schematic representation of the magnetic circuits in the embodiment of FIG. 5.

FIG. 6 shows the magnetic coupling of the secondary windings 61–64 of the output transformer 37 of the PTI with the associated primary winding 65 through individual cores 66*a*, 66*b*, 66*c* and 66*d*.

Figure 7:
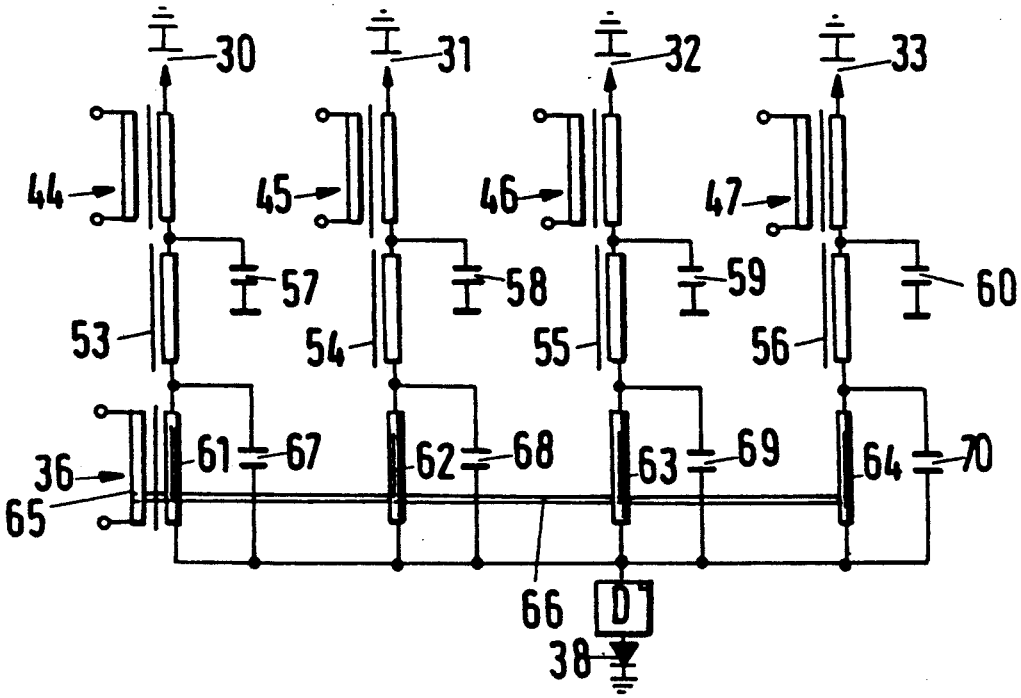
FIGS. 7–11 are schematic diagrams showing additional representative embodiments of the invention.
Figure 8:
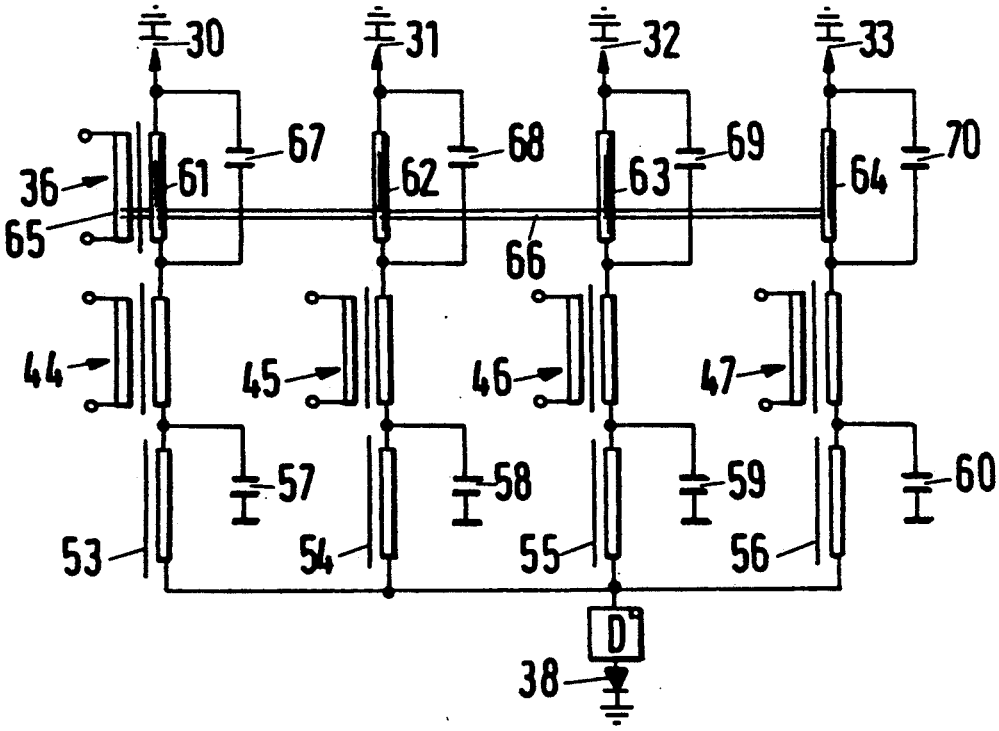

As can immediately be seen from FIGS. 7 and 8, which are the same except that the sequences of individual circuit components are transposed, the embodiments of FIGS. 3 and 4 or of FIGS. 3 and 5 may alternatively be combined into a single circuit. In the embodiments shown in FIGS. 5 and 8, care must be taken with regard to insulation since the PTI 36 is at a higher voltage than in the other embodiments.

Figure 9:
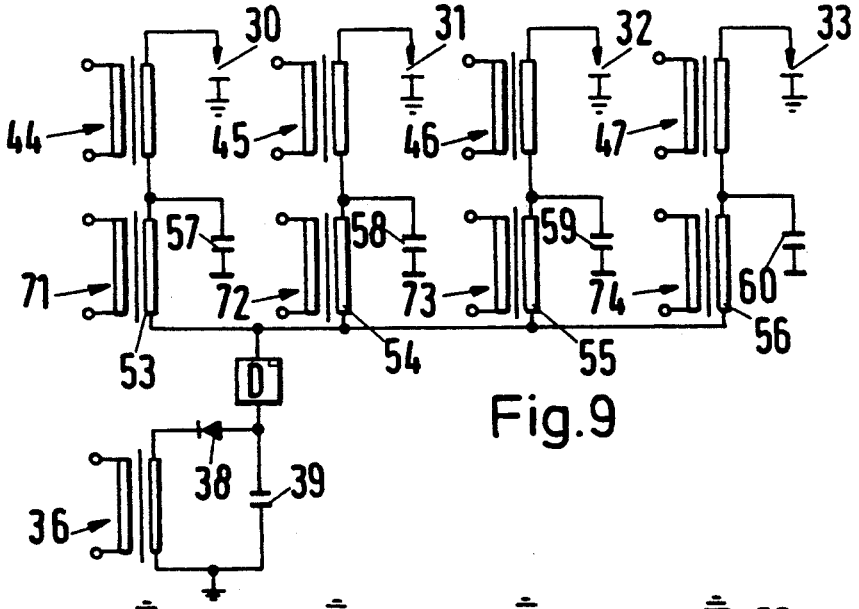
Figure 10:
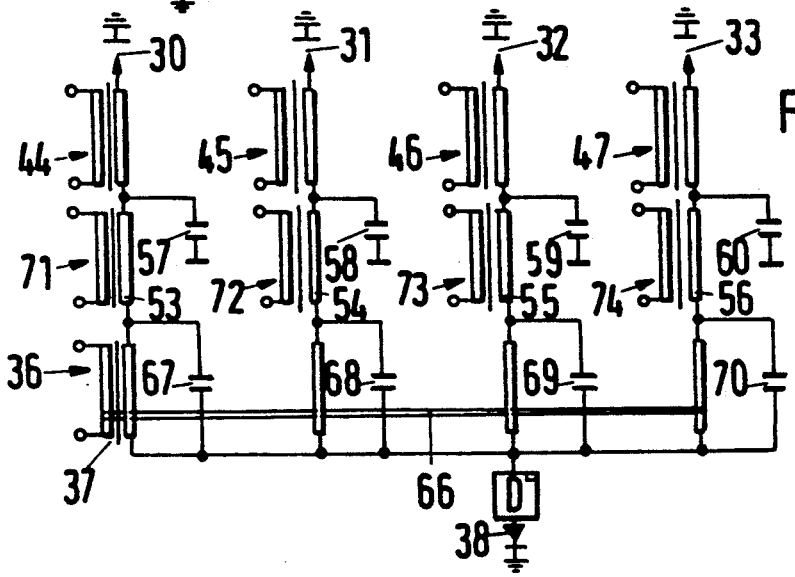
Figure 11:
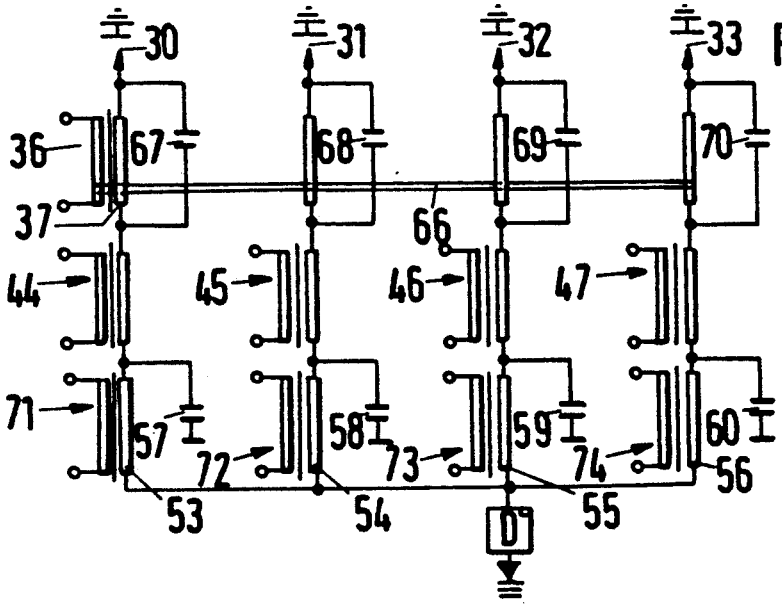

The further embodiments of ignition systems shown in FIGS. 9, 10 and 11 are similar to those of FIGS. 3, 7 and 8, and the corresponding parts are identified with identical reference numerals. In these embodiments, the inductances 53, 54, 55 and 56 constitute the secondary windings of transformers 71, 72, 73 and 74, which are driven by external excitation and serve to control the transition between the modes of operation of the HVCIs and the PTI. If desired, additional ignition devices may be connected to the input terminals of the transformers 71–74. Preferably, however, the PTI 36 provides the input to those transformers since it already has a transformer.

So far, the diagnostic unit D has only been mentioned and has not been described in detail. As may be seen in FIGS. 2–11, the ignition system according to the invention provides especially convenient arrangements for insertion of a diagnostic unit for detecting failures which may occur in any part of the ignition system. A number of appropriate embodiments of the diagnostic unit are described hereinafter with reference to the drawings.

In the embodiment shown in FIG. 12, the diagnostic unit D has two terminals 80 and 81. The terminal 80 corresponds, for example, to the junction 52 in the embodiment of FIG. 2. The diagnostic unit D in FIG. 12 contains a voltage sensor formed by an LED 83 connected in series with a resistor 82 and a current sensor formed by an LED 84 in the line between the terminals 80 and 81. Conventional photosensitive units 85 and 86, with light-transmitting elements 87 and 88 and photoresponsive elements 89 and 90, are arranged to generate voltage- and current-indicating signals. Accordingly, an electrical signal representing the voltage curve with respect to time (t), as shown in FIG. 13, may be produced at the terminals 91 and 92 and an electrical signal representing the current flow with respect to time (t), as shown in FIG. 14, may be produced at the terminals 93 and 94. In FIGS. 13 and 14, the PTI is switched on by the control system at a time A and, after a time period $t_1$, it charges a condenser, for example, the condenser 39 in FIG. 2, up to an amplitude of, for example, 1.5 kV, which is reached at the time A' in FIG. 13. The corresponding HVCI is then ignited at the time B and during the time period $t_2$ the burning condition of the arc between the electrodes of the spark plug is represented by the line F in FIG. 13 and the line G in FIG. 14.

A variety of failure conditions will now be described with reference to FIGS. 15–20.

A crack in the insulating ceramic of the spark plug, i.e., an insulation failure, becomes apparent, as shown in FIGS. 15 and 16, because of voltage disruptions or current peaks during the time period $t_1$. This failure may therefore most easily be detected by integration of the voltage and current curves during the time period $t_1$. This integrated value i up to the time A' of the voltage curve or up to the time E of the current curve is stored in the diagnostic unit in a conventional manner and is evaluated by comparison with the integrated values which are obtained in the normal condition of the ignition system.

Integration of current and voltage during the time period $t_1$ also shows the effect of a leak due to soot or to a coating of moisture in cold start. FIG. 17 shows the voltage curve and FIG. 18 shows the current curve with respect to time (t), three different degrees of fouling a, b and c being assumed in the voltage curve. The integrated value i is drawn on a different scale, as it is in FIGS. 15 and 16. On the other hand, the electrode gaps of the spark plugs under consideration are monitored by their effect on the combustion voltage in the time period $t_2$. To eliminate fluctuations due to the respective operating states, it is advantageous to average the integrated values i shown in FIGS. 19 and 20.

The fluctuation of current with time is a measure of the flow pattern of the fuel-air mixture in the combustion chamber. FIG. 21 shows the integrated value i of the voltage in the range $t_2$ with the flow pattern in the combustion chamber varying with time. The flow of the mixture causes the arc between the electrodes to drift without interrupting the burning thereof. Only when flows are strong can interruptions of the combustion occur. FIG. 22 shows the corresponding current curve, from which it can be determined whether the burning was interrupted.

Figure 23:
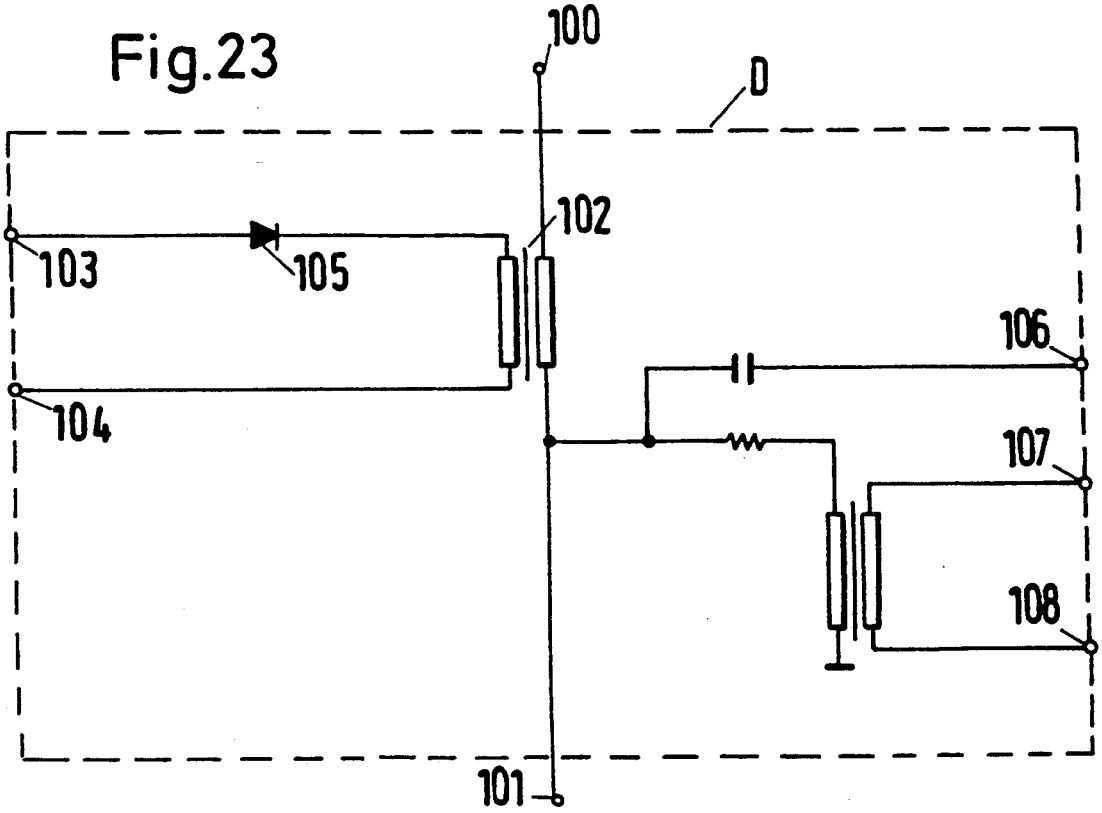
FIG. 23 is a schematic diagram showing another example of a diagnostic arrangement.
Figure 24:
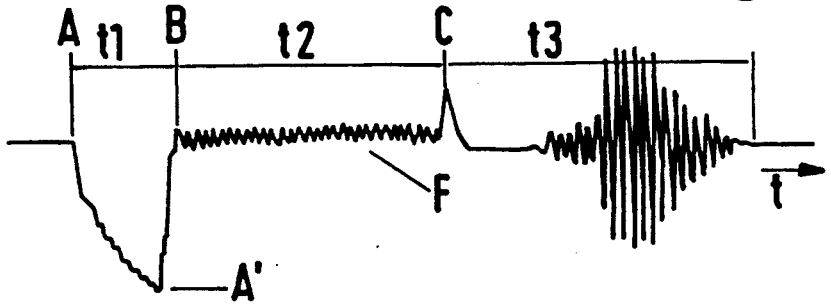
FIGS. 24 and 25 are graphical illustrations showing voltage and current curves in the diagnosis of engine knocking.
Figure 25:
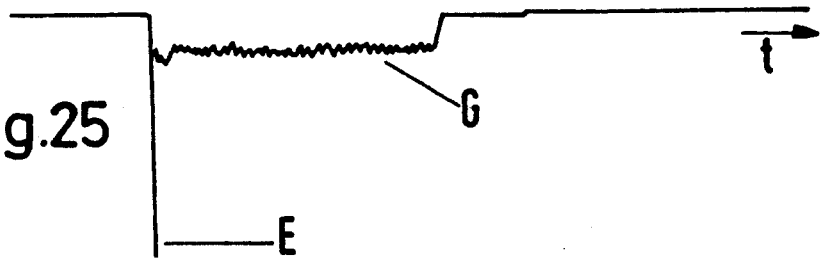
Figure 26:
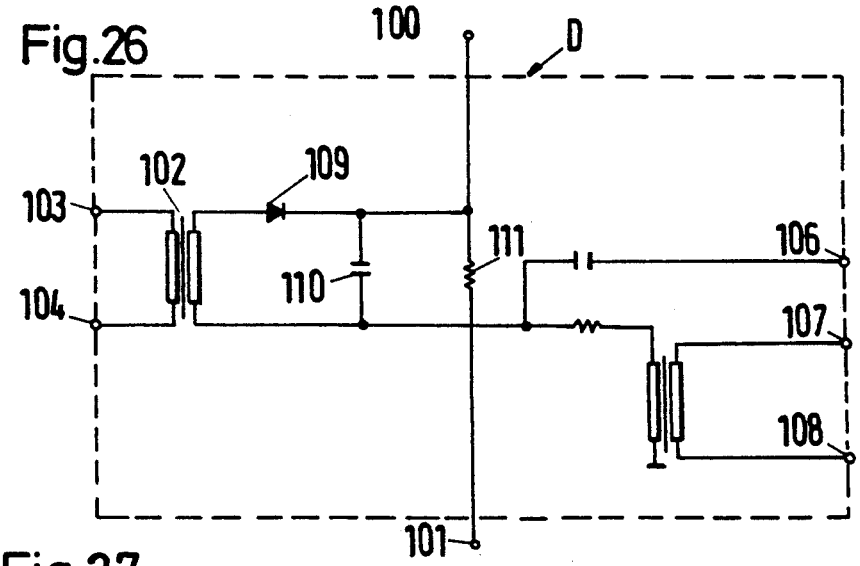
FIGS. 26 and 27 are schematic diagrams showing two further embodiments of a diagnostic arrangement.

The diagnostic units shown in FIGS. 23 and 26 are designed to detect knocking. Considering first the arrangement shown in FIG. 23, a transformer 102, connected between two terminals 100 and 101, is supplied from a power stage of the PTI through two terminals 103 and 104 and a diode 105. The operation of this diagnostic unit is based on the fact that the motion of the cloud of electrons during the combustion process is modulated by any knocking that may occur. In such knocking, the modulation frequency is in the range from 5–15 kHz. After completion of the ignition process, i.e., within a time period $t_3$, a positive accelerating voltage with a frequency of, for example, 75 kHz, is applied through the transformer 102 to the central electrodes of the spark plugs. The modulation frequency is thereby scanned, as it were, and the voltage curve illustrated in FIG. 24 can be measured at an output terminal 106 or between two further output terminals 107 and 108. The current curve shown in FIG. 25 may be used to control the corresponding current amplitude.

The diagnostic unit D of FIG. 26 constitutes a variation of that of FIG. 23, and the same reference numerals are used for corresponding parts. In this case, however, a direct voltage rather than an alternating voltage is applied as the accelerating voltage to the terminals 103 and 104 for the transformer 102 with a rectifier 109 and a smoothing condenser 110 being connected across a resistor 111 and hence across the spark plug electrodes. A compromise must be made in this circuit with reference to the selection of the resistor 111. If the resistance is too high, it reduces the magnitude of the current and if the resistance is too low the power loss is too great.

Alternatively, the circuits of FIGS. 12 and 23 and of FIGS. 12 and 26 may be combined, if desired. The first combination is shown in FIG. 27, which consequently uses the reference numerals of FIGS. 12 and 23.

Figure 28:
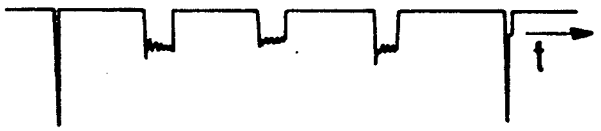
FIGS. 28 and 29 are graphical illustrations showing voltage and current curves indicating the failure of an HVCI.
Figure 29:
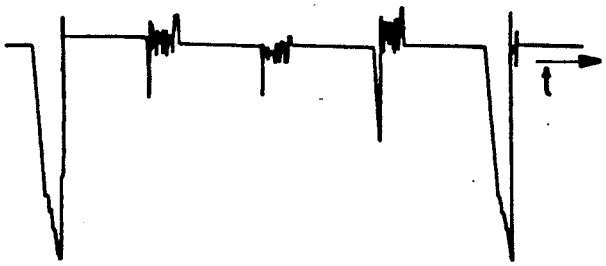

These diagnostic units also permit the detection and localization of additional failures. Thus, FIG. 28 shows the current curve and FIG. 29 shows the voltage curve in the event of failure of an HVCI, in each case with respect to time (t). When this happens, the PTI runs in the direction of its no-load value until the voltage on the electrodes of the spark plug in a combustion chamber during the exhaustphase produces a discharge. At that time, burning of the arc takes place only during a small part of the intended duration.

Figure 27:
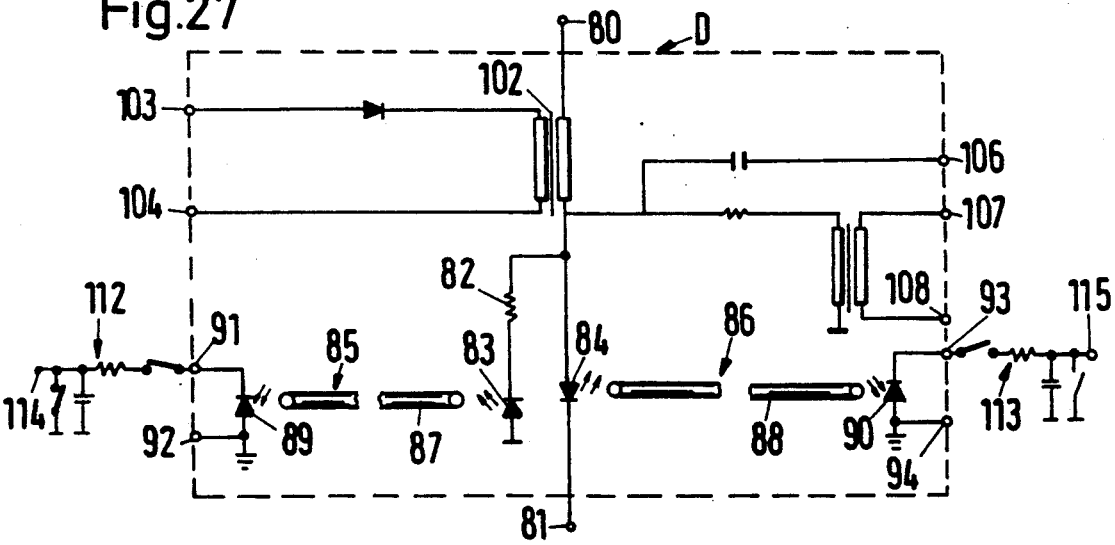

The embodiment of FIG. 27 includes two additional connectable and disconnectable integrators 112 and 113 for voltage and current, respectively, having output terminals 114 and 115. These terminals produce control or regulating signals which are at least intermittently connected to one or more of the control elements 8, 9, 10 and 18–25 in the PTI shown in FIG. 1. Thus, the ignition frequency of the PTI and/or the ignition energy and/or the duration of combustion and/or the time point of connection may be made dependent upon the status of the ignition system and the corresponding combustion chamber. This assures that any ignition difficulties are not only detected but are eliminated or compensated for.

The invention therefore provides an ignition system which, while avoiding mechanically moving parts, supplies ignition energy which is determined by the operating parameters of the internal combustion engine to corresponding spark plugs at precisely predetermined times and provides an advantageous opportunity for use of a diagnostic system built into the vehicle.

Although the invention has been described herein with reference to specific embodiments, many modifications and variations therein will readily occur to those skilled in the art. Accordingly, all such variations and modifications are included within the intended scope of the invention.

We claim:

1. An electronic ignition system for an internal combustion engine having a plurality of spark plugs comprising a plurality of high-voltage condenser ignition devices (HCVIs) having output transformers and switches controlled by signals of an ignition distributor, each HVCI assigned to a corresponding spark plug to provide a precisely timed spark energy source, at least one common ignition device comprising a programmable transistor ignition system (PTI) connected in series with the individual HVCIs and common to at least one group of spark plugs as in ignition energy generator influenceable by engine parameters, the PTI including a direct-current voltage source, an output transformer and an electronic switch having a switching frequency which is a multiple of the firing frequency of each spark plug and which is effective to provide pulsewise cut-in of the direct-current voltage source to its output transformer during predetermined intervals of time through timing elements which are controllable as a function of operating and environmental parameters.

2. An ignition system according to claim 1 wherein the secondary circuit of the PTI output transformer includes a capacitor selected in accordance with the inductances of the secondary windings of the transformers of the HVCIs so that the voltage generated by the PTI in those secondary windings is limited to prevent undesired ignition processes.

3. An ignition system according to claim 1 including a plurality of inductances connected in series with the PTI and the corresponding HVCIs to prolong the ignition signals provided by the HVCIs for small ignition currents.

4. An ignition system according to claim 3 wherein each of the inductances is a component of an externally excited transformer for controlling transition behavior between the PTI and the HVCIs.

5. An ignition system according to claim 1 wherein the PTI output transformer has a separate secondary winding connected to each of the HVCIs.

6. An ignition system according to claim 5 wherein separate iron cores having a common primary winding are provided for each of the separate secondary windings.

7. An ignition system according to claim 5 wherein the spark plugs are connected to the PTI output transformer.

8. An ignition system according to claim 1 including diode means for isolating the PTI from the HVCIs.

9. An ignition system according to claim 1 wherein the spark plugs are connected to HVCI output transformers.

10. An ignition system according to claim 1 including diagnostic means having voltage and/or current sensor means connected in series with the PTI.

11. An ignition system according to claim 10 wherein the diagnostic means is connected between the PTI and ground.

12. An ignition system according to claim 10 wherein the diagnostic means is connected between the PTI and the HVCIs.

13. An ignition system according to claim 10 wherein the diagnostic means include light-transmitting means for transmitting signals from the sensor means.

14. An ignition system according to claim 10 wherein the diagnostic means includes at least one integrator for integrating voltage and/or current signals with respect to time.

15. An ignition system according to claim 14 wherein the integrator is effective during the time between the starting time of the PTI and the ignition time of each of the HVCIs to detect insulation defects.

16. An ignition system according to claim 14 wherein the integrator is effective during the time an ignition spark burning voltage is applied to a spark plug to detect defective ignition conditions.

17. An ignition system according to claim 10 wherein the diagnostic means is arranged to supply an accelerating voltage to the spark plugs after cut-off of the corresponding HVCIs and includes an evaluating circuit for detecting oscillations in the kilo cycle frequency area to provide indications of knocking.

18. An ignition system according to claim 17 wherein the accelerating voltage is a direct-current voltage.

19. An ignition system according to claim 17 wherein the accelerating voltage is an alternating voltage with a frequency which is a multiple of the frequency of any oscillations to be expected.

20. An ignition system according to claim 10 wherein output signals from the diagnostic means are utilized as control signals for the PTI.

* * * * *